US008117754B2

(12) United States Patent
Lion et al.

(10) Patent No.: US 8,117,754 B2
(45) Date of Patent: Feb. 21, 2012

(54) FIXED-BLADE KNIFE HAVING A MULTI-PURPOSE GUARD

(75) Inventors: Mathieu Lion, Paris (FR); Lucas Bignon, Cachan (FR)

(73) Assignee: Mastrad, S.A., Paris (FR)

( * ) Notice: Subject to any disclaimer, the term of this patent is extended or adjusted under 35 U.S.C. 154(b) by 566 days.

(21) Appl. No.: 11/875,498

(22) Filed: Oct. 19, 2007

(65) Prior Publication Data

US 2009/0100683 A1 Apr. 23, 2009

(51) Int. Cl.
*B26B 3/06* (2006.01)
*B26B 29/02* (2006.01)

(52) U.S. Cl. ..... 30/138; 30/153; 30/164; 30/286

(58) Field of Classification Search ..... 30/138, 30/153, 164, 286
See application file for complete search history.

(56) References Cited

U.S. PATENT DOCUMENTS

| | | | | |
|---|---|---|---|---|
| 300,858 | A | 6/1884 | Feicker | |
| 971,057 | A * | 9/1910 | Luce | 132/75.4 |
| 1,352,108 | A | 9/1920 | Arthur | |
| 2,791,831 | A | 5/1957 | Hollis | |
| 3,308,533 | A | 3/1967 | Holohan | 30/32 |
| 3,702,501 | A | 11/1972 | Wood | 30/153 |
| 4,083,110 | A * | 4/1978 | Goldin et al. | 30/155 |
| 4,442,559 | A | 4/1984 | Collins | |
| D275,449 | S * | 9/1984 | Ferraro | D8/99 |
| 4,547,965 | A | 10/1985 | Moore | 30/153 |
| 4,587,735 | A | 5/1986 | Walters et al. | 30/286 |
| 4,707,920 | A | 11/1987 | Montgomery | |
| 5,250,064 | A | 10/1993 | Schneider | 606/167 |
| 5,437,101 | A | 8/1995 | Collins | 30/153 |
| 5,581,893 | A | 12/1996 | Ouellette | 30/286 |
| 6,105,255 | A | 8/2000 | Cheng | 30/161 |
| 6,113,617 | A * | 9/2000 | van der Merwe | 606/167 |
| 6,398,635 | B1 | 6/2002 | DeMezzo | 452/17 |
| 6,493,946 | B1 | 12/2002 | Carrillo | 30/295 |
| 6,625,890 | B2 | 9/2003 | Hufnagel et al. | 30/344 |
| 6,918,183 | B2 | 7/2005 | Alfi | 30/151 |
| 2002/0188309 | A1 * | 12/2002 | Adelman et al. | 606/167 |
| 2003/0061714 | A1 | 4/2003 | Pope | |
| 2005/0153641 | A1 | 7/2005 | Miltner et al. | |
| 2005/0229404 | A1 | 10/2005 | Nordqvist et al. | |
| 2007/0245570 | A1 * | 10/2007 | Tsuda | 30/161 |

FOREIGN PATENT DOCUMENTS

| | | |
|---|---|---|
| DE | 299 06 617 | 7/1999 |
| EP | 0 217 972 | 4/1987 |

OTHER PUBLICATIONS

Written Opinion of the International Searching Authority which includes an International Search Report, PCT/US08/79949, mailed Dec. 11, 2008.
Supplementary EU Search Report—Apr. 11, 2011—EP 08 84 0078.

* cited by examiner

*Primary Examiner* — Ghassem Alie
(74) *Attorney, Agent, or Firm* — Connolly Bove Lodge & Hutz LLP

(57) ABSTRACT

A fixed-blade knife having a knife body. The knife body has a blade with a cutting edge and an elongated handle extending from the blade. A guard is pivotally coupled to the knife body and adapted to be actuated between an open position and a closed position. The guard has an external surface that is ergonomically configured for handling the knife when the guard is in the open position. In the open position, the guard is positioned adjacent the handle to expose the cutting edge. In the closed position, the guard is positioned adjacent the blade to cover the cutting edge.

5 Claims, 5 Drawing Sheets

FIXED-BLADE KNIFE HAVING A MULTI-PURPOSE GUARD

BACKGROUND OF THE INVENTION

1. Field of the Invention

The present invention relates to knives, and in particular, to knives having a protective guard for the cutting edge and tip.

2. Description of Related Art

Knives come in a variety of shapes and sizes and are adapted for a multitude of uses. There are at least two main categories of knives: fixed-blade knives and folding knives. Fixed-blade knives do not have folding blades and are typically stronger and more stable than folding knives due to their fixed blade-handle construction. Fixed-blade knives are common among knives found in the kitchen and used for food preparation, such as to chop, mince, slice and dice foods. Folding knives, on the other hands, can pivot along the blade to fold into the handle. Unlike fixed-blade knives, folding knives do not have a fixed blade-handle construction and thus are not as strong or as stable as fixed-blade knives. Folding knives are commonly used as utility knives or weapons. An adaptation of a folding knife is a switch blade, which may include a spring mechanism to deploy or close the knife blade from the handle.

There are certain desired characteristics for knives used in food preparation. The cutting edge or blade of the knife should be sharp enough to cut through the food and the knife weight and balance should facilitate ease of handling during use. They should also be stable with respect to handling during use. For example, the blade should not present the possibility of folding over during use. Because of the demands placed on kitchen knives, folding knives are generally regarded as unsuitable for use in food preparation and are difficult to clean. Therefore, an overwhelming majority of all kitchen knives are fixed-blade knives.

The safe and proper storage of kitchen knives is also important so as to prevent dulling of the cutting edge and also to prevent accidental injuries. Fixed-blade knives do not have the advantage of having the blade fold into and covered by the handle. Therefore, kitchen knives must be stored in a knife block or other suitable device that covers and protects the cutting edge and tip of the knife. The need for protecting the cutting edge and tip of the knife is particularly important for ceramic blade knives, which may be very fragile.

Knives, however, are often also stored in a drawer unprotected. This not only creates a risk of damage to the knife blade and tip but also a risk of accidental injury when a hand shuffles through the drawer. Protective covers or sheaths may be provided for the kitchen knives; however, such devices may not be convenient as they may frequently become lost or misplaced.

Moreover, there are circumstances in which knives may be transported from one location or another. For example, professional chefs are known to use their own knives and therefore carry a set of knives with them wherever they are needed to cook. It is therefore important to ensure that the knife blades are adequately covered and/or protected during transportation.

Thus, it would be desirable to have a fixed-blade knife that is suitable for use in the kitchen and that also provides a mechanism for protecting the knife cutting edge and tip from damage and from causing injury to others.

SUMMARY

The embodiments of the fixed-blade knives disclosed herein are suitable for use in any application and, in particular, in the kitchen where the fixed blade and handle construction provides stable knife handling. In addition, the fixed-blade knives provide a mechanism for protecting the knife cutting edge and tip from damage and from causing accidental injury to others when the knife is stored or transported. Thus, the embodiments disclosed herein are directed to fixed-blade knives, which are generally characterized as having a handle and a blade that is fixed together and do not fold together or are joined by a pivot or other moving joint.

The fixed-blade knives disclosed herein utilize a guard that is either pivotally or slidably coupled to the knife body. The guard may be actuated between an open position, which exposes the blade for use, and a closed position, which covers and protects the cutting edge of the blade for storage or transportation. The external surface of the guard is further configured to provide an improved grip for handling the knife.

In one preferred embodiment, a fixed-blade knife is provided. The fixed-blade knife comprises a knife body with a blade having a cutting edge and an elongated handle extending from the blade. A guard is pivotally coupled to the knife body and has an open position and a closed position. In the open position, the guard is positioned adjacent the handle to expose the cutting edge. In the closed position, the guard is positioned adjacent the blade to at least partially cover the cutting edge.

In accordance with one aspect of the preferred embodiment, the knife body may be formed as a single integral structure. Alternatively, the blade and the handle may comprise two separate structures, made of different material, which are immovably joined together.

In accordance with another aspect of the preferred embodiment, the guard is pivotally coupled to the handle proximate to the blade. The guard may further comprise a blade slot to receive the cutting edge when the guard is in the closed position. Additionally, a sharpening element may be disposed within the blade slot to sharpen the blade.

In accordance with a further aspect of the preferred embodiment, the handle comprises a ridge and a flange extending from the ridge. The guard may thus further comprise a flange slot to receive the flange when the guard is in the open position.

In another preferred embodiment, a fixed-blade knife is provided. The fixed-blade knife comprises a blade having a cutting edge and a handle having a first and second end. The first end of the handle is proximal to the blade and the second end of the handle is distal to the blade. A guard is pivotally connected to the first end of the handle and includes a blade slot. The blade slot receives the cutting edge of the blade when the guard is positioned adjacent the blade.

In accordance with one aspect of the preferred embodiment, the handle may comprise a ridge and a flange extending from the ridge and the guard may be pivotally connected to the flange. The guard may further comprise a flange slot to receive at least a portion of the flange when the guard is positioned adjacent the ridge.

In accordance with another aspect of the preferred embodiment, the width of the ridge may be greater than the width of the flange slot so as to prevent the guard from further pivoting past the ridge.

In accordance with a further aspect of the preferred embodiment, the guard may further comprise a lock to stabilize the position of the guard in either the open or closed position.

In a further embodiment, a fixed blade knife is provided. The fixed-blade knife comprises a knife body having a blade with a cutting edge and an elongated handle extending from the blade. The fixed-blade knife also comprises a flange extending from the handle and a guard pivotally coupled to the flange. The guard comprises spaced apart walls which define a cavity. When the guard is positioned adjacent the blade, the cavity receives at least a portion of the cutting edge. When the guard is positioned adjacent the handle, the cavity receives at least a portion of the flange.

In accordance with one aspect of the preferred embodiment, the guard further comprises a bolster that prevents a user's hand from slipping onto the blade when the guard is positioned adjacent the handle.

In accordance with another aspect of the preferred embodiment, the fixed-blade knife further comprises a guard lock to secure the guard to the knife body. The guard lock may be a hook that is coupled to the guard and that may be attached to either the handle or the blade, depending on the position of the guard.

In accordance with a further aspect of the preferred embodiment, the fixed-blade knife further comprises a sharpening element disposed within the cavity. The sharpening element may be used to sharpen the cutting edge when the guard is pivotally actuated in relation to the cutting edge. The sharpening element may be biased at an angle towards the cutting edge when the cutting edge is placed inside the cavity.

In accordance with yet a further preferred embodiment, the fixed-blade knife comprises a knife body having a blade with a cutting edge and an elongated handle extending from the blade. A guide is slidably disposed along the knife body between an open position exposing the cutting edge and a closed position covering the cutting edge. The guard has an exterior surface adapted to provide a grip for handling the knife.

In accordance with one aspect of the preferred embodiment, the fixed-blade knife further comprises a stop that prevents the guard from disengaging from the knife body.

In accordance with another aspect of the preferred embodiment, the handle comprises a rail and the guide comprises a channel corresponding to the rail. The rail and channel are adapted to slidably dispose the guard between the open and closed position.

In accordance with a further aspect of the preferred embodiment, the guard comprises a rail and the handle comprises a channel corresponding to the rail. Again, the rail and channel are adapted to slidably dispose the guard between the open and closed position.

Other objects, features and advantages of the present invention will become apparent to those skilled in the art from the following detailed description.

BRIEF DESCRIPTION OF THE DRAWINGS

Like numerals refer to like parts throughout the several views of the drawings.

DETAILED DESCRIPTION OF EMBODIMENTS OF THE INVENTION

Figure 1:
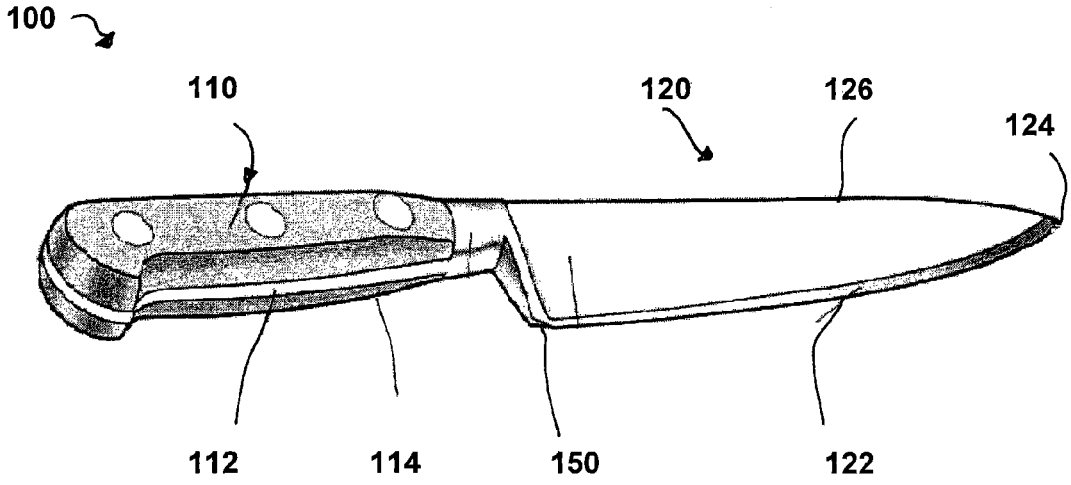
FIG. 1 is a perspective view of a basic knife.

FIG. 1 depicts a general purpose knife (100) that is commonly used in food preparation. The knife (100) comprises three main parts: a handle (110), a blade (120), and a bolster (150). The knife (100) depicted in FIG. 1 is an example of a fixed-blade knife because the handle (110) and the blade (120) are permanently attached to one another. There is no mechanism by which the handle (110) and blade (120) can be moved or folded relative to each other.

The main parts of the blade (120) include the cutting edge (122), tip (124), and spine (126). The main working part of the blade is the cutting edge (122), which extends from the tip (124) to the bolster (150). The spine (126) is the top of the blade directly opposite the cutting edge (122) and the spine (126) is the surface on which a user's hand may be placed to apply direct pressure on the cutting surface when cutting or chopping hard food items. The spine (126) may also be handled to guide the knife (100) while cutting or chopping. Because kitchen knives are subject to pressure on all sides of the blade, it is among the reasons why folding knives would not be appropriate. For example, in the process of applying pressure on the spine (126) or other knife part, there is the possibility of having the blade (120) fold or collapse relative to the handle.

The main parts of the handle (110) include the tang (112) which extends from the blade and is designed to give the knife balance. In certain embodiments, the handle (110) may comprise solely of the tang (112) itself. In these embodiments, the tang (112) is shaped so as to provide a suitable grip for handling. In certain other embodiments, as depicted in FIG. 1, the handle (110) may further include scales (114) which are permanently affixed to the tang (112) and create a wider grip for the handle (110). The tang (112) may be an extension of the blade (120) or separately provided and permanently affixed to the blade (120).

The bolster (150) is the thick junction between the handle (110) and the blade (120). The bolster (150) is configured to give the knife (100) balance and to prevent the hand from accidentally slipping from the handle (110) to the blade (120) during use.

Kitchen knives must be stored in a manner to prevent damage to the cutting edge of the blade and also to prevent accidental injury. Since the knife depicted in FIG. 1 does not include a mechanism to protect the cutting edge, it must be carefully stored or secured in a knife block or other suitable device which prevents the cutting edge from contacting other objects. Proper knife storage is important to extending the life of the knife.

Figure 2A:
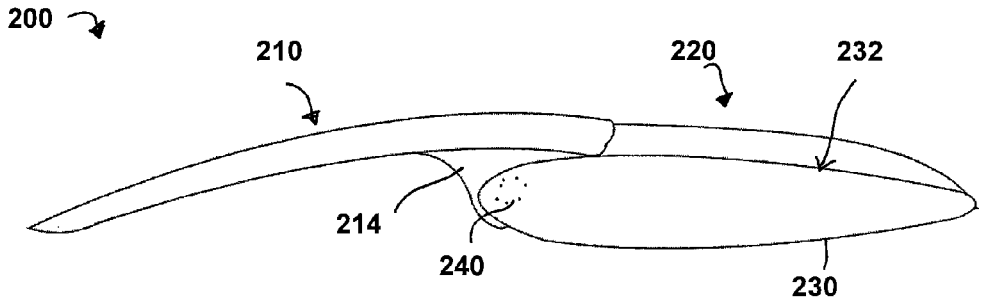
FIGS. 2A-C are side views of a fixed-blade knife in accordance with one embodiment in which the guard is pivotally actuated from the handle to the blade.
Figure 2B:
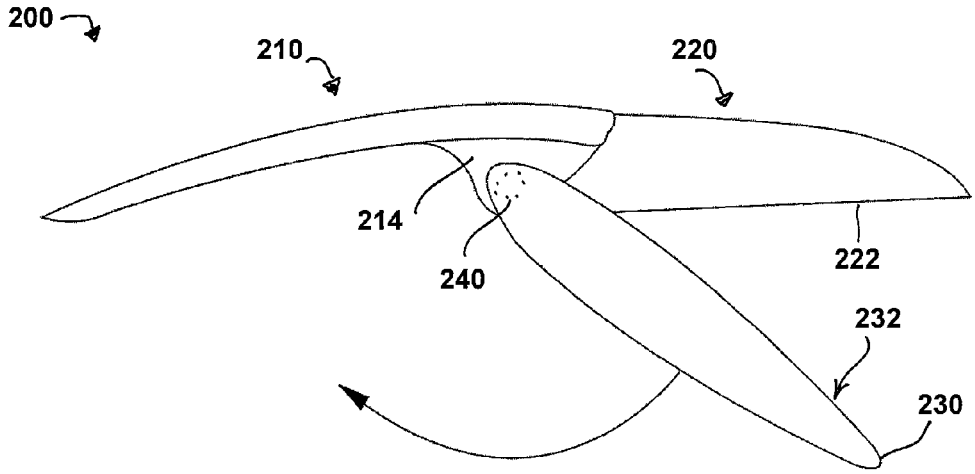
Figure 2C:
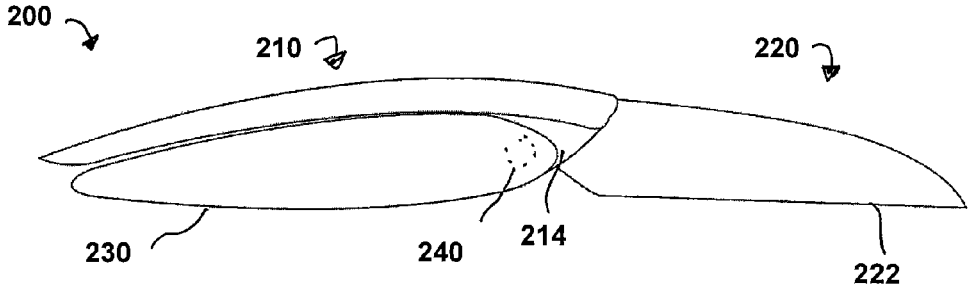

FIGS. 2A-C are side views of a fixed-blade knife (200) in accordance with one embodiment. The fixed-blade knife (200) comprises a handle (210), a blade (220) having a cutting edge (222) and a guard (230). The handle (210) in turn comprises a flange (214) to which the guard (230) may be pivotally attached by a pivot joint (240). The pivot joint (240) may be any joint that is capable of actuating the guard (230) relative to the knife (200) between a closed position (FIG. 2A) and an open position (FIG. 2B). In a closed position (FIG. 2A), the guard may be position adjacent the blade whereas in the open position (FIG. 2B), the guard may be positioned adjacent the handle.

The guard (230) may be configured in any number of ways. The guard (230) may comprise a pair of walls (430*a*, 430*b* in FIG. 5) defining a blade slot (232 in FIGS. 2A-B, 435 in FIG. 5) for receiving and protecting the cutting edge (222) when the guard is in the closed position (FIG. 2A). In the embodiment depicted in FIGS. 2A-C, the guard (230) comprises a blade slot (232) to receive and house the cutting edge (222) of the blade (220) when the guard (230) is in the closed position (FIG. 2A).

The guard (230) may also be configured to have an external surface of sufficient width and dimension to provide a grip for handling the knife (200). In this regard, the guard (230) may be ergonomically configured by including, for example, rubber or plastic grips, depressions to accommodate a user's fingers, etc. to further enhance handling of the knife (200). Thus the guard (230) serves to provide both improved handling of the knife (200) when in use and also to protect the cutting edge (222) when the knife (200) it is not in use.

The pivot joint (240) may be any joint that permits the guard (230) to pivot between the closed and open positions relative to the knife (200). For example, the pivot joint (240) may be formed by mating a nipple protruding from the guard (230) inner surface towards a corresponding groove provided on the flange (214). Alternatively, the pivot joint (240) may be formed by mating a protruding nipple on the flange (214) with a corresponding groove on the guard (230) inner surface.

Figure 3A:
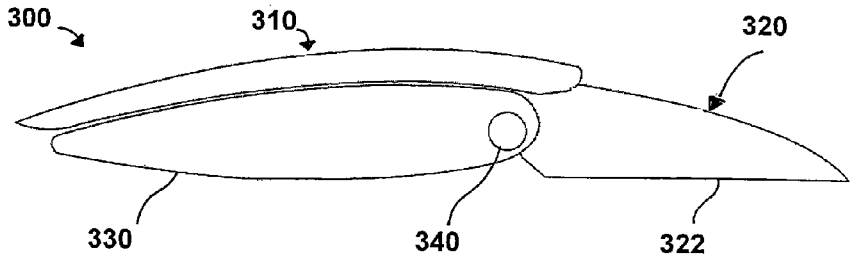
FIGS. 3A-C are side views of a fixed-blade knife in accordance with another embodiment in which the guard is pivotally actuated from the handle to the blade.
Figure 3B:
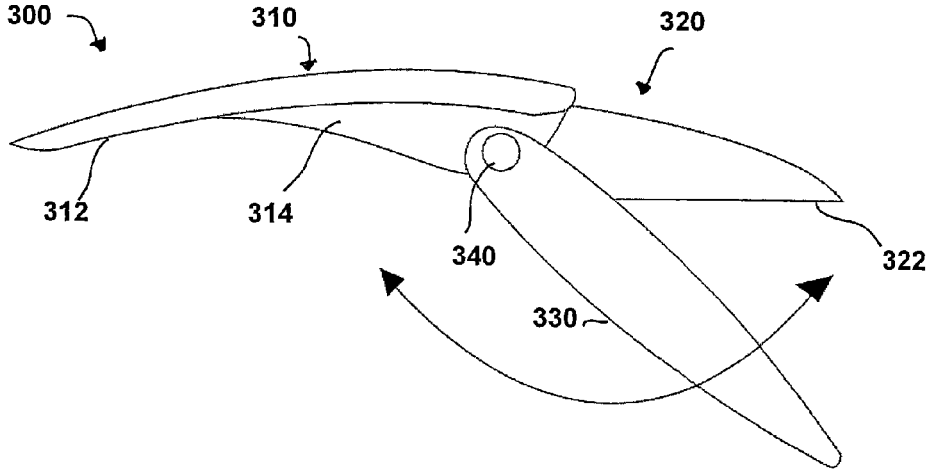
Figure 3C:
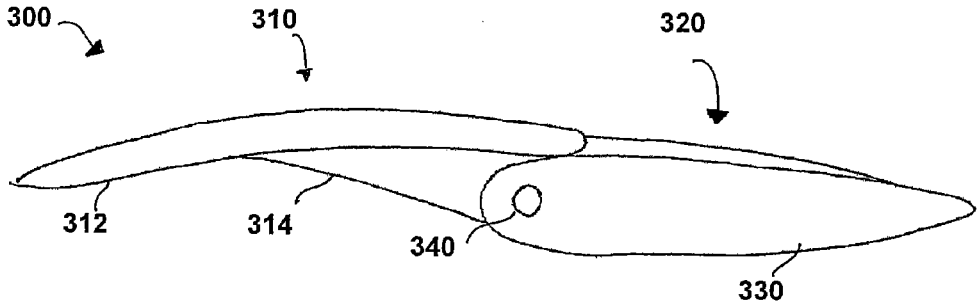

FIGS. 3A-C are side views of a fixed-blade knife (300) in accordance with another embodiment. The fixed-blade knife (300) depicted in FIGS. 3A-C generally comprises a handle (310), a blade (320) having a cutting edge (322) and a guard (330). The handle comprises a ridge (312) and a flange (314) extending therefrom and the handle (310) is permanently and immovably coupled to the blade (320). The guard (330) is pivotally connected to the flange (314) by means of a joint (340). As previously explained, the joint (340) may comprise any joint or connector which permits rotation of the guard (340), as shown in FIG. 3B, between the open position (FIG. 3A) and the closed position (FIG. 3C). In addition to protecting the cutting edge (322) of the knife (300) when the guard (330) is in the closed position, the guard (330) may be configured to provide an improved handling surface when the guard (330) is in the open position.

Unlike the fixed-blade knife depicted in FIGS. 2A-C, the fixed-blade knife depicted in FIGS. 3A-C includes a flange (314) that is elongated. The elongated flange (314) is received by the guard (330) in the open position (FIG. 3A). Thus, guard (330) may further be configured to include a flange slot (not depicted) to receive the elongated flange (314) and to further stabilize the guard (330) from lateral movement while the knife (300) is in use. In certain embodiments, the blade slot or cavity and the flange slot may be a single slot that runs through the guard (330). In other embodiments, the blade slot and the flange slot may be separately provided on the guard (330). Moreover, the outer surface of the guard (330) may be shaped to improve knife handling when the guard is in the open position.

The embodiment in FIGS. 3A-C show the handle (310) comprising a ridge (312). This ridge (312) provides the handling surface and, in addition, is shaped to stop the guard (330) from rotating past the ridge (312). Thus, the ridge (312) functions both as a handling surface for the knife as well as a stop for the guard (330). Thus typically, the width of the ridge (312) will be greater than the width of the flange slot.

The knife (300) may further be provided with a lock (not depicted) so as to secure the guard (330) in either the open or closed position. The lock may comprise, for example, a hook that is coupled to the guard (330) at the end that is distal to the joint (340). The handle (310) and the blade (320) may each further comprise a notch to receive the hook and secure the guard in either the open or closed position.

Although FIGS. 3A-C depict the guard (330) being pivotally attached to the knife (300) at the flange (314), the guard (330) may also be pivotally attached to any part of the knife handle (310) so long as the guard (330) may be pivoted between the open and closed position.

Figure 4:
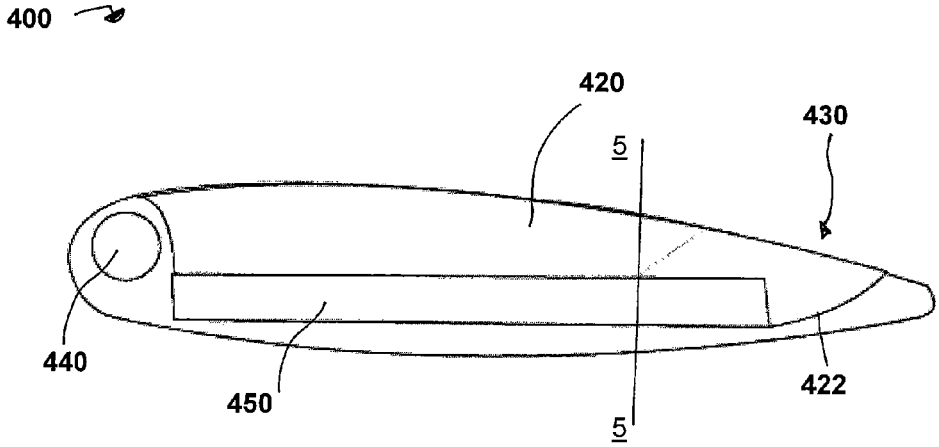
FIG. 4 is a side view of a blade contained within a guard having a sharpening agent disposed within the guard and in contact with the blade.

FIG. 4 is a side view a blade (420) contained within a guard (430) having a sharpening element (450) disposed within the guard (430) and in contact with the blade (420). The sharpening element (450) allows for the sharpening of the cutting edge (422) of the blade (420) when the sharpening element (450) is contacts the cutting edge (422) and the guard (430) is actuated in relation to the blade (420). The sharpening element (450) may extend across a significant length of the blade, as depicted in FIG. 4, or it may extend across only a portion of the blade length.

Figure 5:
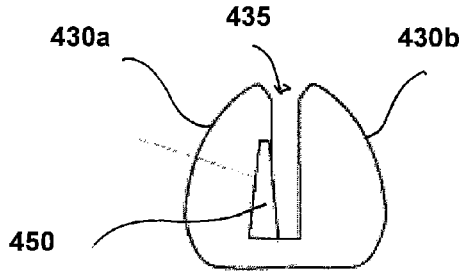
FIG. 5 is a cross-sectional view of the guard taken along 5-5 in FIG. 4.

FIG. 5 shows a cross-sectional view of the guard (430) showing the guard walls (430*a*, 430*b*) taken along 5-5 in FIG. 4. As can be seen in FIG. 5, a sharpening element (450) is on one side of the guard cavity (435). The sharpening element (450) is shaped such that when the blade is positioned inside the guard cavity (435), the sharpening element (450) is biased and an angle towards the cutting edge (not depicted).

Thus, when the blade is positioned within the guard cavity (435), the cutting edge may be sharpened by applying a slight pressure to the outside of the guard (430*a*) to urge the sharpening element (450) toward the blade concurrently with the pivoting of the guard (430) away from the blade. This process may be repeated any number of times until the desired sharpening is achieved. Although the sharpening element (450) is depicted in FIG. 4 as being only on one side of the guard cavity, embodiments in which the sharpening element (450) provided on both sides of the guard cavity are included within the scope of the invention.

Knives may be sharpened by grinding the cutting edge of the blade against a hard rough surface, typically made of stone or synthetic material. There are a number of factors that determine the extent of sharpening that is achieved. One such factor is the angle between the blade and the sharpening agent. In general, a greater sharpening effect will be achieved when the angle between the blade and the sharpener is relatively small, approximately 10-30°. Knives having more durable cutting edges may be sharpened at 30° or more. In general, if the cutting edge is made of hard material, the higher the angle between the blade and the sharpener.

Another factor affecting the effectiveness of a knife sharpener is the composition of the sharpening element. The material selected for the sharpening element depends, in part, upon the composition of the blade. Sharpeners are generally made of a material that is harder than the blade that it is designed to sharpen, typically steel or other metal, ceramic, stone, and the like. Typically metal sharpeners have a fine grain and provide an improved finish to a blade. Sharpeners may also be made of ceramic or diamond-ceramic material, which are difficult to break, easy to use, and wear resistant. Such sharpeners will not rust or require lubrication. Ceramic is generally preferred over steel for sharpening hard metal blades, such as stainless steel, as ceramic is among the hardest material on the Rockwell Scale.

Figure 6A:
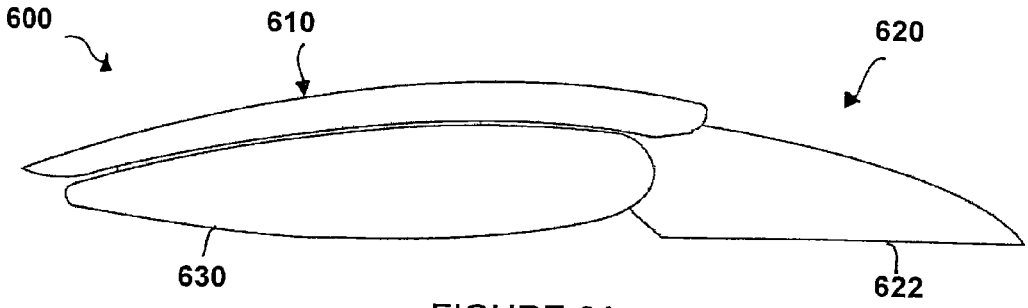
FIGS. 6A-C are side views of a fixed-blade knife in accordance with a further embodiment in which the guard is slidably disposed along the handle between an open and a closed position.
Figure 6B:
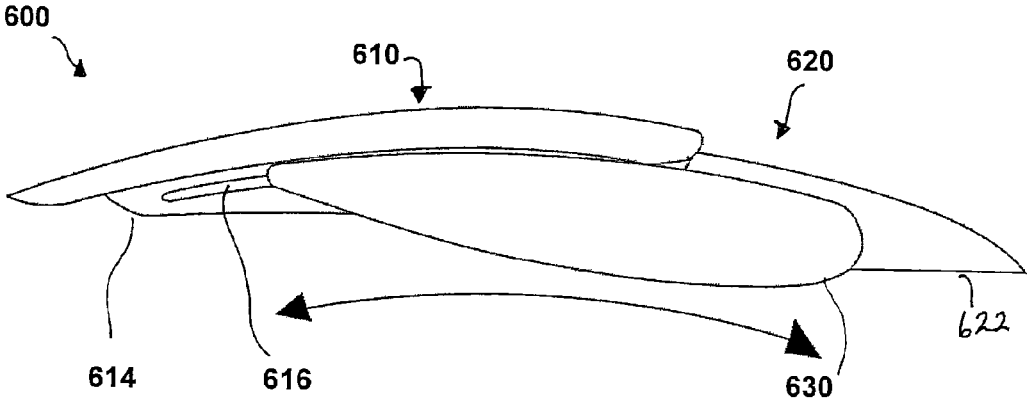
Figure 6C:
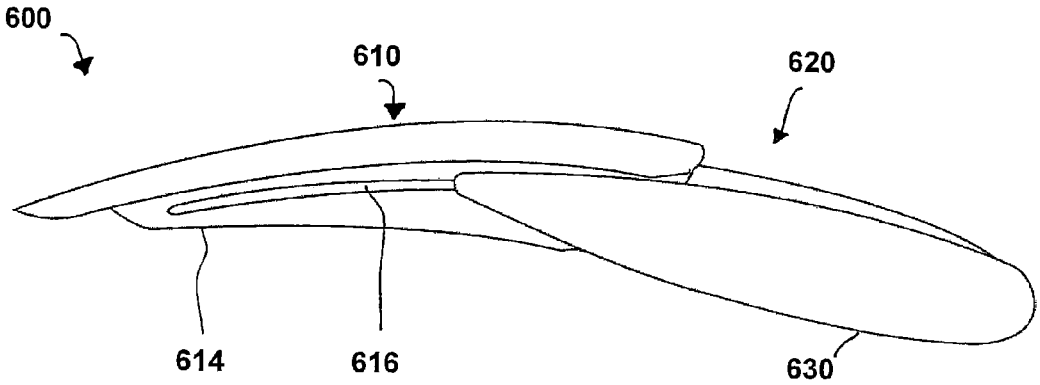

FIGS. 6A-C depict a fixed-blade knife (600) in accordance with a further embodiment in which the guard (630) is slidably disposed along the handle (610) and blade (620) between an open position (FIG. 6A) and a closed position (FIG. 6C). The fixed-blade knife (600) generally comprises a handle (610), a blade (620) having a cutting edge (622) and a guard (630).

In one embodiment, the handle (610) comprises an elongated flange (614) which includes a rail (616) protruding from the flange (614). The guard (630) includes a corresponding channel or groove (not depicted) along its inner surface that mates with the rail (616) to slidably dispose the guard between an open position (FIG. 6A) and a closed position (FIG. 6C) by a sliding motion (FIG. 6B). Alternatively, the rail (616) may be provided along the inner surface of the guard (630) which is then mated with a corresponding channel or groove along the elongated flange (614). Moreover, the rail (616) and groove may be provided on both sides of the flange (614) and guard (630), respectively, so as to further secure the guard (630) onto the knife (600). The knife (600) may further comprise a locking mechanism by which the guard (630) is secured in the open or closed positions. This may be accomplished by providing a snap lock at the two ends of the rail and/or channel.

It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

What is claimed is:

1. A fixed-blade knife comprising:

a fixed blade knife body comprising a single blade having a cutting edge and an elongated handle extending from the blade, the elongated handle having a rounded surface and a ridge portion; a flange extending downwardly from the handle and substantially perpendicular to the ridge portion; a guard pivotally coupled to the knife body and adapted to be actuated between an open position and a closed position, the guard comprising a rounded external surface; and a pivot joint disposed about a flange and coupling the guard on opposite sides of the flange;

wherein in the open position, the guard is coupled to the handle to expose the cutting edge, the rounded surface of the handle and the rounded external surface of the guard being contiguous to one another along the entire length of the guard and providing an ergonomic handling surface and the ridge portion of the handle abutting the guard to prevent the guard from rotating over the ridge portion; and wherein in the closed position, the guard is positioned adjacent the blade to cover both sides of the cutting edge.

2. The fixed-blade knife of claim 1 wherein the knife body forms an integral structure.

3. The fixed-blade knife of claim 2, wherein the guard is pivotally coupled to the handle proximate to the blade.

4. The fixed-blade knife of claim 3, wherein the guard comprises a blade slot to receive the cutting edge when the guard is in the closed position.

5. The fixed-blade knife of claim 4, further comprising a sharpening element disposed within the blade slot.

* * * * *